United States Patent [19]

Perevodchikov et al.

[11] Patent Number: 4,469,982

[45] Date of Patent: Sep. 4, 1984

[54] ELECTRON-BEAM TUBE

[75] Inventors: Vladimir I. Perevodchikov; Pavel I. Akimov; David A. Skibityansky; Valentina N. Shapenko; Lev V. Loginov; Alexandr L. Shapiro; Arkady N. Yakovlev, all of Moscow; Vitaly M. Kosmachevsky, Reutovo Moskovskoi, all of U.S.S.R.

[73] Assignee: Vsesojuzny Energetichesky Institut Imeni V. I. Lenina, Moscow, U.S.S.R.

[21] Appl. No.: 373,485

[22] PCT Filed: Aug. 27, 1980

[86] PCT No.: PCT/SU80/00146

§ 371 Date: Apr. 19, 1982

§ 102(e) Date: Apr. 19, 1982

[87] PCT Pub. No.: WO82/00734

PCT Pub. Date: Mar. 4, 1982

[51] Int. Cl.[3] ..... H01J 1/46; H01J 21/10

[52] U.S. Cl. ..... 313/293; 313/276; 313/302; 313/304; 313/30

[58] Field of Search ..... 313/296, 294, 302, 304, 313/32, 30, 293

[56] References Cited

U.S. PATENT DOCUMENTS

| | | | |
|---|---|---|---|
| 2,512,858 | 6/1950 | Hegbar | 313/32 |
| 2,817,031 | 12/1957 | Bennett | 313/32 |
| 2,844,752 | 7/1958 | Hoover | 313/304 X |
| 2,866,122 | 12/1958 | Doolittle et al. | 313/302 |
| 3,798,476 | 3/1974 | Abramian et al. | 313/302 |
| 4,011,481 | 3/1977 | Preist | 313/304 |
| 4,197,481 | 4/1980 | Phipps et al. | 313/293 |
| 4,277,718 | 7/1981 | Shrader | 313/296 |

*Primary Examiner*—Saxfield Chatmon
*Attorney, Agent, or Firm*—Lilling & Greenspan

[57] ABSTRACT

A electron-beam tube comprises a cathode (2) made as individual tapes (6) disposed throughout the length of the tube, whose surfaces are the emitting portions of the cathode (2). Each tape (6) of the cathode (2) is provided with a near-cathode focusing electrode (9) electrically connected to the cathode (2) and disposed in the immediate vicinity of the tape (6), and with a pair of rods (10) of the control electrode (3) disposed in relation to the tape (6) so that the whole electron flow focused by the near-cathode electrode (9) passes between said rods (10). The following relations are observed in the tube:

$$a/b=c/d;\ 1<d/c\leqq 10;\ e\geqq b.$$

where a—the width of the tape (6) of the cathode (2);

b—the width of the input slot (17) for the electron flow of the chamber (13) of the anode (5);

c—the distance between the tape (6) of the cathode (2) and the rods (10) of the control electrode (3);

d—the distance between the rods (10) of the control electrode (3) and the ribs (16) of the chamber (13) of the anode (5);

e—the depth of the chamber (13) of the anode (5).

2 Claims, 3 Drawing Figures

ELECTRON-BEAM TUBE

BACKGROUND OF THE INVENTION

1. Field of the Invention

The present invention relates to electronic devices and, in particular, to electron-beam tubes.

2. Background Art

Known in the art are electron-beam valves wherein the cathode is a cylindrical tablet and an additional electrode whose potential is higher than that of the anode is accommodated between the cathode and anode (cf., for example, USSR Inventor's Certificate No. 367,482, Class HO1j 21/10, published in Inventions, Discoveries, Industrial Designs, Trade Marks Bulletin, No. 8, 1973).

The design of such valves permits commutation of voltages up to several hundred kilovolts and the efficiency is fairly high. But such valves produce an electron beam from a limited emission surface of the cathode and this is a restriction beyond which the power of valves cannot be increased to the order of several tens of megawatts.

One possibility of providing devices rated for greater power is the use of a multibeam principle for an electron-optical system featuring extended emission cathode surfaces.

Known in the art are electron beam tubes comprising several components coaxially arranged in succession one after another in the direction of the electron flux: a cathode, a control electrode made as a bunch of rods, and a chamber anode whose chambers are formed by the ribs and the bottom located opposite the emitting portions of the cathode (cf., for example, USSR Inventor's Certificate No. 291,607, Class HO1j 21/10, published in Discoveries, Inventions, Industrial Designs, Trade Marks Bulletin, No. 29, 1976).

In such tubes the cathode is assembled around a cylindrical base and is provided with emitting areas which are surfaces of cylindrical rings, the width of each disc electron beam from cathode to anode being constant. With this design the size of the input slot of the anode chamber cannot be significantly increased since it cannot exceed the width of the electron beam on the cathode. In this connection the distance from the butt ends of the anode chamber ribs to the control grid (electrode) is approximately equal to the distance from the control grid to the cathode. The maximum permissible operational voltage and the efficiency of such tubes are substantially limited. If the operational voltage is increased by extending the distance from the anode to the control grid, the current in the tube drops and, consequently, the power is reduced too.

SUMMARY OF THE INVENTION

The present invention essentially resides in providing an electron beam tube wherein the cathode unit and electrode units located in the immediate vicinity thereof are designed and the geometrical dimensions of the units are selected so that the operational voltage could be increased to hundreds of kilovolts, currents could be raised to hundreds of amperes, and the efficiency maintained at a level of 99%.

This object is achieved in an electron-beam tube comprising several components which are coaxially arranged and disposed successively one after another in the direction of the electron flux, including a cathode, a control electrode made as bunch of rods, and a chamber anode whose chambers are formed by ribs and the bottom located opposite the emitting portions of cathode where, according to the invention, the cathode is made of individual tapes extending throughout the length of the tube, whose surface is the emitting portion of the cathode, each tape being provided with a near-cathode focusing electrode which is electrically coupled to the cathode and is disposed in the immediate vicinity thereof, and a pair of rods of the control electrode, which are arranged in relation to the cathode tape so that the electron flux focused by the near-cathode electrode passes between said rods, the width of each cathode tape, geometrical dimensions of each anode chamber and the distance between the cathode tapes, rods of the control electrode and ribs of the anode chamber being selected in accordance with the following relationships:

$$a/b=c/d;\ 1<d/c\leqq 10;\ e\geqq b,$$

where a—width of cathode tape;

b—width of input slot for electron flow of the anode chamber;

c—distance between the cathode tape and rods of the control electrode;

d—distance between rods of the control electrode and ribs of the anode chamber;

e—depth of the anode chamber.

Advisably, tapes of the cathode should be placed in pipes having longitudinal slits as outlets for the electron flow, the walls of each slit being the near cathode focusing electrode.

Desirably, rods of the control electrode should be made hollow and filled with a coolant.

Possibly, an additional rib should be set in front of each rib of the anode chamber in relation to the direction of the flow of electrons, perpendicular to said rib and at a certain distance therefrom, additional ribs should be spaced apart so that butt ends of adjacent additional ribs form an input slot for the electron flow of each anode chamber.

Desirably, the ribs forming each anode chamber should be made as hollow rods filled with a coolant.

Advisably, a protective electrode should be provided in the tube, which is arranged coaxially in relation to the cathode, between the chamber anode and the control electrode in the immediate vicinity of the latter, and having apertures whose number is equal to the number of cathode tapes for letting the electron flow focused by the near-cathode electrode to the anode chambers.

Desirably, the protective electrode should be made as a cylinder having longitudinal slits which are apertures for letting through the electron flow focused by the near-cathode electrode to the anode chambers.

The above design of an electron-beam tube permits, according to the invention, production of power of the order of several tens of megawatts continuously.

BRIEF DESCRIPTION OF DRAWINGS

The invention will now be described in greater detail with reference to concrete embodiments thereof in conjunction with accompanying drawings, wherein.

DESCRIPTION OF THE PREFERRED EMBODIMENTS

Figure 1:
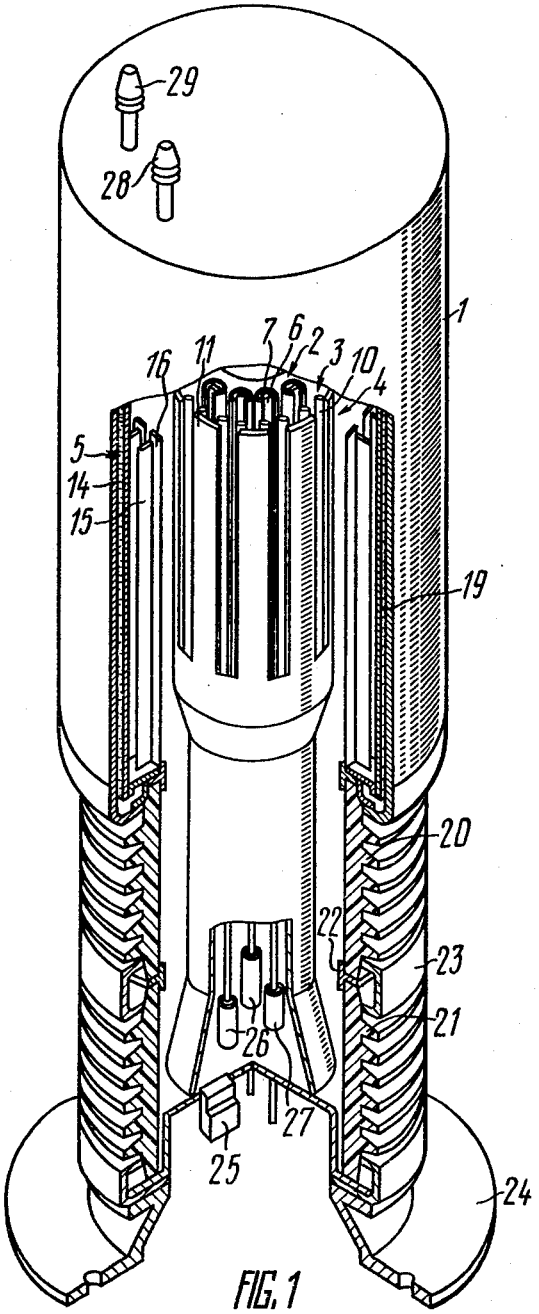
FIG. 1 illustrates a general axonometric view of an electron-beam tube, according to the invention.

An electron-beam tube comprises, according to the invention, a casing 1 (FIG. 1) housing a cathode 2, a control electrode 3, a protective electrode 4 and a chamber anode 5, all said components being arranged coaxially and disposed in succession one after another downstream the flow of electrons.

The cathode 2 is made of individual tapes 6 arranged along the length of the tube, the surface of said tapes 6 being the emitting portions of the cathode 2. The tapes 6 are placed in pipes 7 having longitudinal slits 8 (FIG. 2) for letting the electron flow out. The walls of each slit 8 are near-cathode focusing electrodes 9 which are electrically connected to the cathode 2.

Each cathode tape may be provided with a near-cathode focusing electrode of a different design, but it is important that it is located in the immediate vicinity of the cathode tape.

The control electrode 3 (FIG. 1) is made of rods 10. Each tape 6 (FIG. 2) is furnished with a pair of rods 10 arranged in relation to the tape 6 so that the electron flow focused by the near-cathode electrode 9 passes between said rods 10.

The protective electrode 4 (FIG. 1) is placed in the immediate vicinity of the control electrode 3 and is made as a cylinder 11 having longitudinal slits 12 (FIG. 2) whose number is equal to that of the tapes 6 of the cathode 2 and which are apertures for letting the electron flow focused by the near-cathode electrode 9 to the chamber anode 5.

The protective electrode may be of a different design, but it is important that the number of apertures is equal to the number of cathode tapes in order to let the electron flow focused by the near-cathode electrode to the chamber anode.

Each chamber 13 of the chamber anode 5 is formed by a bottom 14 which is a part of the cylinder common for all chambers 13 and located opposite one emitting portion of the cathode 2, in this embodiment opposite the tape 6, by main ribs 15 set a certain distance from the bottom 14 and perpendicular thereto, and additional ribs 16 set before each rib 15 in relation to the direction of the electron flow, perpendicular to the rib 15 and spaced somewhat therefrom. Ribs 16 are spaced from one another so that butt ends adjacent ribs 16 form an input slot 17 for the electron flow of the chamber 13.

Figure 2:
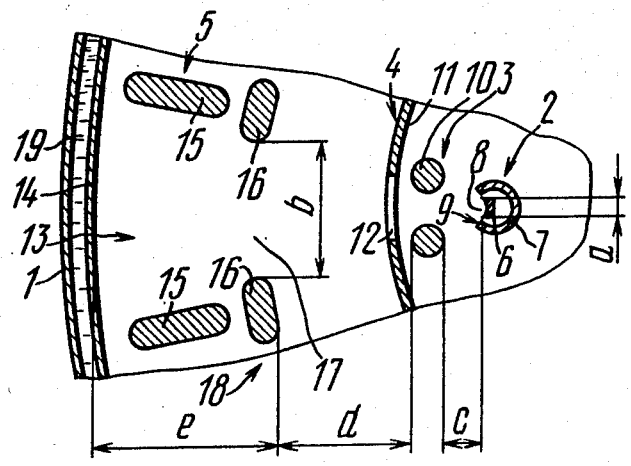
FIG. 2 illustrates a cross-sectional view of a module of the electron-beam tube of FIG. 1.

The above described tape 6 of the cathode 2, a pair of rods 10 of the control electrode 3, the protective electrode 4 made as a cylinder 14 having a slot 12, and the chamber 13 of the chamber anode 5 constitute one module 18 of an electron-beam tube, according to the invention, of FIG. 2. The proposed embodiment of the tube provides for 18 modules.

For each module 18 of the tube, according to the invention, the width of each tape 6 of the cathode 2, geometrical dimensions of each chamber 13 of the anode 5, and the distance between the tapes 6 of the cathode 2, rods 10 of the control electrode 3 and ribs 16 of the chamber 13 of the anode 5 are selected in accordance with the following relationships:

$$a/b=c/d \quad (1);$$

$$1<d/c\leqq 10 \quad (2);$$

$$e\geqq b \quad (3),$$

where a—width of the tape 6 of the cathode 2;

b—width of the input slot 17 for the electron flow of the chamber 13 of the anode 5;

c—distance between the tape 6 of the cathode 2 and the rods 10 of the electrode 3;

d—distance between the rods 10 of the control electrode 3 and the ribs 16 of the chamber 13 of the anode 5;

e—depth of the chamber 13 of the anode 5.

There is space filled with coolant, namely water 19, between the cylinder forming the bottom 14 of all chambers 13 and the casing 1.

The anode 5 (FIG. 1) is insulated from the cathode 2 by means of insulators 20 and 21 placed one over the other and connected by the butt ends thereof via a ring adapter 22. The place of connection of the insulators 20 and 21 is shielded by an electrostatic screen 23. The other butt ends of the insulators 20 and 21 are connected, respectively, to the butt portion of the bottom 14 of the chamber anode 5 and to the flange 24 which is the outlet of the cathode 2 and the base of the electron-beam tube, according to the invention. The flange 24 carries a magnetic-discharge pump 25, two insulators 26 for introduction of the filament voltage and an insulator 27 for introduction of the control voltage.

The casing 1 is furnished with connecting pipes 28 and 29 as inlets for the water 19 cooling the chamber anode 5.

The above embodiment of the electron-beam tube has solid rods 10 of the control electrode 3 and solid ribs 15, 16 of the chamber 13 of the anode 5. This embodiment is most advisable for anode currents up to several tens of amperes.

Figure 3:
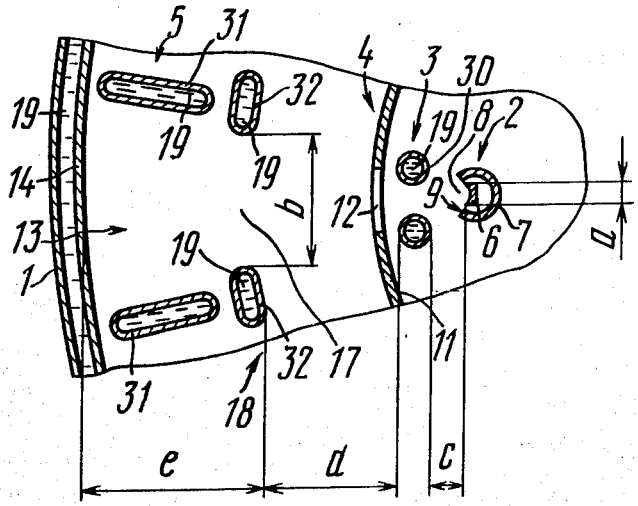
FIG. 3 illustrates a cross-sectional view of a module of another embodiment of an electron-beam tube, according to the invention.

With the anode current up to hundreds of amperes the embodiment of FIG. 3 can be successfully used. The electron-beam tube of FIG. 3 is similar to that of FIG. 1, the difference being that the rods 30 of the control electrode 3 are made hollow and ribs 31 and 32 forming each chamber 13 of the anode 5 are made as hollow rods. All said hollow rods are filled with coolant, namely water 19, which permits dissipation of up to 1,000 kilowatts on the anode.

The electron-beam tube according to the invention operates as follows.

A separate voltage source (not shown) supplied a specific potential required to produce a specific anode current to the control electrode 3 (FIG. 1). A tape electron flow is produced in each module 18 (FIGS. 2 and 3), which permits significant increase of the current passed through the tube since the maximum steady current of the tape electron flow grows with the length of the tape 6 (FIG. 1). This tape in the present embodiment of the tube can amount to 40 centimeters. In this manner, making use of the total length of the tape 6 of the cathode 2, with some constant accelerating voltage, current per unit of tube volume can be substantially increased. Having gone through the control electrode 3, electrons move in the decelerating field of the anode 5 whose potential stays somewhere between the potentials of the cathode 2 and the control electrode 3. Moreover, the potential of the anode 5 is selected to as close to the potential of the cathode 2 as possible, but to avoid reflection of the electron flow. The current flowing through the tube is controlled by changing the potential of the control electrode 3. The distance between adjacent rods 10 of the control electrode 3 is selected so that the rods 10 are not bombarded by primary electrons. The length of the deceleration leg dictates the level of operational voltage and, accordingly, the electrical strength of the gap between the control electrode 3 and the anode 5. The width of each tape electron flow in the decelerating field grows the nearer it comes to the anode 5. The proposed ratio of geometrical dimensions of the tube electrodes, according to the invention, ensures complete passage of the electron flow into a respective chamber 13 (FIGS. 2 and 3) of the anode 5. Condition (1) ensures maximum stability of current of the tape electron flow.

Inequality (2) is characteristic of the voltage level of the tube, permissible voltage applied externally to the anode 5 (in relation to the cathode 2), and the efficiency of the tube. Inequality (3) characterizes the geometry of the chamber 13 of the anode 5 when the secondary emission from the bottom 14 of the chamber 13 of the anode 5 is low.

The protective electrode 4 whose potential is equal to that of the cathode 2 is intended to reduce the current let through to the control electrode 3 when the potential of the anode 5 is less than the potential of the control electrode 3. Electrons reflected from the anode 5 are brought back due to the minimum potential produced between the additional ribs 16 of the anode 5 and the control electrode 3.

The efficiency of the electron-beam tube, according to the invention, depends upon the losses for deceleration of the electron flow and the current level applied to the control electrode 3:

$$\eta = 1 - \frac{I_1 \cdot U \cdot I_2 \cdot U_2}{U_m \cdot I_2} \qquad /4/$$

where $I_1$—current of the control electrode 3;

$U_1$—potential of the control electrode 3;

$I_2$—current of the anode 5;

$U_2$—voltage between cathode 2 and anode 5 when the tube is opened;

$U_m$—maximum voltage of the anode 5 when the tube is closed.

The expression (4) can be transformed as:

$$\eta = 1 - M/N, \qquad (5)$$

where $$M = U_2/U_1 + I_1/I_2 \qquad (6)$$

and $$N = U_m/U_1 \qquad (7)$$

The second component of the expression (6) can be, in practical terms, neglected. In this case, with a definite value M of deceleration losses and a definite minimum permissible voltage drop across the open tube, the efficiency of the tube is dictated by the parameter N which characterizes the ratio of the potential of the anode 5, when the tube is closed, to the potential of the control electrode 3. In terms of electron optics parameter N varies directly with the ratio of the distance from the control electrode 3 to the anode 5 to the distance from the control electrode 3 to the cathode 2, that is $$N = d/c \qquad (8).$$

As the ratio d/c grows, the efficiency evidently grows too. The top limit of the ratio $d/c \leqq 10$ is dictated by dimensions of the tube and complications involving vacuum processing of tube units. When the ratio $d/c < 1$ the efficiency of the proposed tube substantially dimensions.

The proposed electron-beam tube permits commutation of currents up to 150 A when the anode voltage is about 150 kilovolts when the tube is closed. The maximum voltage of the control electrode can amount to 5 kilovolts. The ratio d/c in this case is 5, and the distance between the control electrode and the anode can be brought to 60 mm. The cathode tape is 6 mm wide, the relations (1) and (2) are observed, and the amount of current deviating during deceleration to the control electrode can be brought to a magnitude less than 0.01 of the anode current. The efficiency of the tube, when employed as a power electron-beam switch, reaches 99 percent.

An electron-beam tube can be used in power converters rated for several tens of megawatts, as electron-beam valves and as a switch.

We claim:

1. An electron-beam tube comprising several components arranged coaxially and disposed in succession one after another downstream the electron flow: a sectionalized cathode provided with a near-cathode focusing electrode; a control electrode made as several rods; and a cylindrical chamber anode whose chambers are formed by ribs and perpendicular anode surfaces located opposite the emitting portions of the cathode, characterized in that the tube comprises a protective electrode (4); that an additional rib (16) is set in front of, and orthogonally relative to each rib (15) of the chamber (13) of the anode (5); that the butt ends of adjacent additional ribs (16) form an input slot (17) for the electron flow produced by the cathode (2) made in the form of a plurality of tapes (6) arranged in the longitudinal direction of the tube; that the control electrode (3) is made in the form of a pair of rods (10) and surrounded by the protective cylindrical electrode (4) galvanically connected to said sectionalized cathode (2), the width of each tape (6) of the cathode (2), geometrical dimensions of each chamber (13) of the anode (5) and the distance between the tapes (6) of the cathode (2), the rods (10) of the control electrode (3) and the ribs (16) of the chamber (13) of the anode (5) being selected in accordance with the following relationships:

$$a/b = c/d;\ 1 < d/c \leqq 10;\ e \geqq b,$$

wherein a is the width of the tape (6) of the cathode (2);

(b) b is the width of an input slot (17) of the electron flow of the chamber (13) of the anode (5);

(c) c is the distance between the tape (6) of the cathode (2) and the rods (10) of the control electrode (3);

d is the distance between the rods (10) of the control electrode (3) and the ribs (16) of the chamber (13) of the anode (5); and e is the depth of the chamber (13) of the anode (5).

2. The electron-beam tube as claimed in claim 1, characterized in that the rods (30) of the control electrode (3) and the ribs (31) and (32) of the chamber anode (5) are made hollow and filled with a coolant.

* * * * *